US007785072B1

(12) United States Patent
Liang

(10) Patent No.: US 7,785,072 B1
(45) Date of Patent: Aug. 31, 2010

(54) LARGE CHORD TURBINE VANE WITH SERPENTINE FLOW COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 567 days.

(21) Appl. No.: 11/900,031

(22) Filed: Sep. 7, 2007

(51) Int. Cl.
*F01D 9/02* (2006.01)

(52) U.S. Cl. ..... 416/97 R

(58) Field of Classification Search ..... 416/97 R
See application file for complete search history.

(56) References Cited

U.S. PATENT DOCUMENTS 5,488,825 A 2/1996 Davis et al.
5,609,466 A 3/1997 North et al.
6,077,034 A 6/2000 Tomita et al.
6,099,244 A 8/2000 Tomita et al.
6,139,269 A 10/2000 Liang
6,142,730 A 11/2000 Tomita et al.
6,508,620 B2 1/2003 Sreekanth et al.
2007/0154312 A1 * 7/2007 Neuhoff et al. ..... 416/97 R

* cited by examiner

*Primary Examiner*—Richard Edgar
(74) *Attorney, Agent, or Firm*—John Ryznic

(57) ABSTRACT

A large chord turbine stator vane with a 5-pass serpentine aft flow cooling circuit with the built-in cooling flow modulation. The first leg of the 5-pass serpentine flow circuit provides the cooling for the airfoil leading edge. The second, third, and fourth legs of the five pass serpentine flow circuit provide cooling for the airfoil mid-chord section which is subject to a lower heat load for the entire component. The fifth and last leg of the serpentine flow circuit provides cooling for the airfoil aft section as well as cooling flow supply channel for the airfoil trailing edge exit cooling slots. Two cooling modulation devices are utilized in this prior art cooling circuit. One is located at the ID endwall for the regulation of the fourth leg of the serpentine flow channel and the other is located on the OD endwall for the regulation of the fifth leg of the trailing edge flow channel. Once the fourth and the fifth legs of the serpentine flow channels are regulated, cooling flow to the second and the third flow channels or legs will be changed simultaneously.

8 Claims, 1 Drawing Sheet

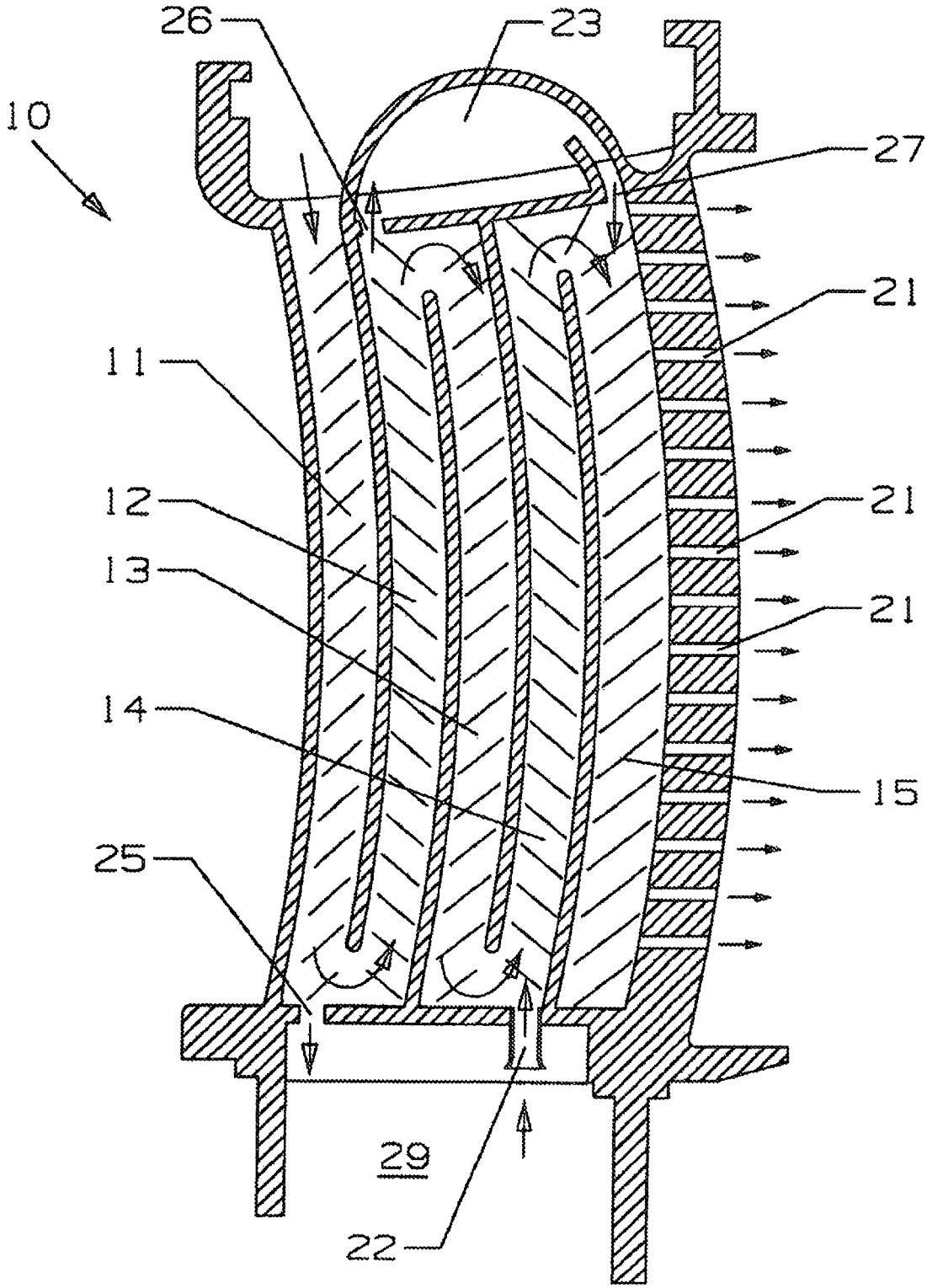
26
23
10
27
21
11
12
21
13
21
14
15
25
29
22

LARGE CHORD TURBINE VANE WITH SERPENTINE FLOW COOLING CIRCUIT

BACKGROUND OF THE INVENTION

1. Field of the Invention

The present invention relates generally to a stator vane in an industrial gas turbine engine, and more specifically to a large chord turbine vane with a cooling circuit.

2. Description of the Related Art Including Information Disclosed Under 37 CFR 1.97 and 1.98

In a gas turbine engine, especially an industrial gas turbine engine, a turbine section includes a plurality of stages of stator vanes and rotor blades to extract mechanical energy from the hot gas flow passing through the turbine. The efficiency of the turbine, and therefore of the engine, can be increased by increasing the turbine inlet temperature of the gas flow from the combustor. However, the temperature is limited to the material properties of the first stage turbine airfoils—the stator vanes and rotor blades—since the first stage airfoils are exposed to the hottest gas flow.

Passing cooling air through the airfoils can also allow for a higher gas flow temperature since the cooled airfoils can be exposed to higher temperatures. Complex convection and film cooling circuits have been proposed in the prior art to maximize the cooling effectiveness of the internal cooling circuits. Increasing the cooling ability while using less cooling air will provide higher efficiency.

In the prior art (U.S. Pat. No. 5,488,825 issued to Davis et al on Feb. 6, 1996 and entitled GAS TURBINE VANE WITH ENHANCED COOLING) large turbine vanes with cooling circuits, the vane airfoil is coupled with a large I.D. and O.D. endwall structure. Frequently an uneven gas temperature profile will enter the turbine stage and the airfoil endwalls are exposed to different gas temperature loading conditions. Also, due to an uneven cooling for the airfoil versus the endwalls, it is very difficult for a cooling circuit design to achieve a long balanced LCF life for a large turbine vane. The Davis et al patent show one prior art vane cooling circuit for a third stage vane of an industrial gas turbine engine which includes a 5-pass aft flowing serpentine cooling circuit with built-in cooling flow modulation device that can be used in a large chord turbine vane cooling circuit.

However, the stator vane cooling circuit of the Davis et al patent has some disadvantages. For the vane trailing edge OD fillet region, due to inadequate cooling for the junction of the airfoil trailing edge fillet versus the endwall location, the vane aft fillet region experiences a low LCF (low cycle fatigue) life. Also, at the vane trailing edge fillet location, a higher heat transfer coefficient or heat load onto the downstream fillet location exists due to the trailing edge wake effect. On top of a higher heat load onto the airfoil fillet location due to the stress concentration issue, the cooling hole for the airfoil trailing edge OD section cannot be located high enough into the vane OD section fillet region to provide proper convective cooling. Cooling of this particular airfoil trailing edge fillet region becomes especially difficult. As the turbine inlet temperature increases with improvements in the technologies of gas turbine engines, larger rotor blades and stator vanes are needed to extract the higher available energy from the hot gas flow. Thus, there is a need in the art of industrial gas turbine engines for larger turbine vanes with increased cooling abilities in order to withstand the larger blade size and higher heat loads.

It is therefore an object of the present invention to provide for a large stator turbine vane with an improved cooling circuit.

It is another object of the present invention to provide for a turbine stator vane with a 5 pass serpentine flow cooling circuit with built-in flow modulation that can be used in a large chord turbine vane cooling circuit.

BRIEF SUMMARY OF THE INVENTION

A large chord turbine stator vane with a 5-pass serpentine aft flow cooling circuit with the built-in cooling flow modulation. The first leg of the 5-pass serpentine flow circuit provides the cooling for the airfoil leading edge. The second, third, and fourth legs of the five pass serpentine flow circuit provide cooling for the airfoil mid-chord section which is subject to a lower heat load for the entire component. The fifth and last leg of the serpentine flow circuit provides cooling for the airfoil aft section as well as cooling flow supply channel for the airfoil trailing edge exit cooling slots. Two cooling modulation devices are utilized in this prior art cooling circuit. One is located at the ID endwall for the regulation of the fourth leg of the serpentine flow channel and the other is located on the OD endwall for the regulation of the fifth leg of the trailing edge flow channel. Once the fourth and the fifth legs of the serpentine flow channels are regulated, cooling flow to the second and the third flow channels or legs will be changed simultaneously.

BRIEF DESCRIPTION OF THE SEVERAL VIEWS OF THE DRAWINGS

The FIGURE shows a side cross sectional view of the turbine vane cooling circuit of the present invention.

DETAILED DESCRIPTION OF THE INVENTION

The FIGURE shows a cross sectional view of the turbine airfoil of the present invention to illustrate the internal serpentine cooling flow circuit with the built-in cooling flow modulation. The first leg 11 of the 5-pass serpentine flow circuit provides the cooling for the airfoil leading edge. The second leg 12, third leg 13, and fourth leg 14 of the five pass serpentine flow circuit provide cooling for the airfoil mid-chord section which is subject to a lower heat load for the entire component. The fifth and last leg 15 of the serpentine flow circuit provides cooling for the airfoil aft section as well as cooling flow supply channel for the airfoil trailing edge exit cooling slots 21. Two cooling modulation or metering devices are utilized in this 5-pass serpentine cooling circuit. A first cooling modulation or metering device 22 is located at the ID (inner diameter) endwall for the regulation of the fourth leg 14 of the serpentine flow channel. A second cooling modulation or metering device 27 is located on the OD (outer diameter) endwall manifold for the regulation of the fifth leg 15 of the trailing edge flow channel. Once the fourth and the fifth legs 14 and 15 of the serpentine flow channels are regulated, cooling flow to the second and the third flow channels 12 and 13 will be changed simultaneously. A first bleed air opening 25 connects the end of the first leg 11 to a cavity 29 at the ID endwall area for the bleed off air from the serpentine flow circuit. A second bleed air opening 26 is located at the end of the second leg 12 and bleeds off air into the cooling air manifold on the OD endwall of the vane. The second modulation/metering device 27 connects the cooling air manifold to the fifth leg 15 of the serpentine flow circuit. As is shown in the FIGURE, trip strips are formed on the walls of the legs to promote heat transfer from the airfoil walls to the cooling air flowing through the serpentine circuit.

In operation, the entire cooling air is channeled through the airfoil leading edge serpentine flow channel (first leg 11) to provide the maximum cooling for the airfoil leading edge, which is the highest heat load region. A portion of the cooling air is then bled off at the end of the first leg 11 downward serpentine cooling channel to provide cooling and purge air for the seal housing and rim cavities at the ID endwall flow path. A cooling flow metering device 22 is built-in at the entrance to the fourth serpentine flow channel 14 within the cavity 29 of the ID endwall location. The first metering or modulation device 22 is used to regulate the cooling flow rate to the fourth serpentine flow channel 14 as well as cooling flow that bypasses the second and third legs or channels 12 and 13 to the aft section of the airfoil. a portion of the cooling air can also be bled off from the end of the second leg 12 and re-supplied into the fifth leg 15 of the serpentine flow circuit through the second modulation device 23 located in the OD endwall of the vane.

Major design features and advantages of the modulating cooling circuit of the present invention are achieved over the prior art 5-pass aft flowing serpentine flow cooling circuit. These advantages include the following. The built-in metering devices at the entrance and exit section of the airfoil mid-chord flow channels modulate the cooling flow and pressure losses to the airfoil mid-chord section and therefore achieve a better thermal match for the airfoil mid-chord versus both endwalls. By-pass cooling air from the airfoil mid-chord section yields less cooling air heat up and allows for a higher cooling potential for the airfoil trailing edge high heat load region. Higher utilization of cooling air to perform cooling for the airfoil leading and trailing edge regions and less cooling for the airfoil mid-chord region yields a more balanced airfoil thermal distribution for the airfoil sectional metal temperature. The built-in metering devices for the serpentine flow channels can be cast in and machined for the adjustment of flow area to fine tune the cooling flow and pressure to each individual flow channels. Constructing a built-in cooling flow modulation metering device for the serpentine flow circuit provides a robust cooling flow control capability for this unique integrated aft flowing serpentine circuit. The built-in cooling flow modulation metering devices at the first and second legs of the serpentine flow channels increases the integrated serpentine flow circuit design flexibility. A balanced thermal distribution or match between the airfoil and the endwall can be achieved and thus a long LCF life for the component is obtained.

I claim the following:

1. An industrial gas turbine stator vane comprising:

an outer diameter endwall and an inner diameter endwall;

an airfoil extending between the outer endwall and the inner endwall;

a 5-pass serpentine flow cooling circuit formed within the airfoil to provide cooling for the airfoil;

the first leg of the serpentine flow circuit located adjacent to the leading edge of the airfoil and the fifth leg located adjacent to the trailing edge of the airfoil;

an inner diameter endwall metering connection connecting an end of the first leg directly to a beginning of the fourth leg of the serpentine flow cooling circuit; and, an outer diameter endwall metering connection connecting an end of the second leg directly to a beginning of the fifth leg of the serpentine flow cooling circuit such that a portion of the cooling air passing through the serpentine flow circuit bypasses the second and third legs through the inner diameter endwall metering connection and a portion of the cooling air passing through the serpentine flow circuit bypasses the third and fourth legs through the outer diameter endwall metering connection.

2. The industrial gas turbine stator vane of claim 1, and further comprising:

the inner diameter endwall metering connection includes a bleed air opening on the end of the first leg and a metering tube on a beginning of the fourth leg.

3. The industrial gas turbine stator vane of claim 2, and further comprising:

the cooling air bypass of the inner diameter endwall metering connection completely bypasses the second and third legs of the serpentine flow cooling circuit.

4. The industrial gas turbine stator vane of claim 1, and further comprising: the outer diameter endwall metering connection includes a cooling air manifold on the outer diameter endwall of the vane, a second bleed off air opening connecting the end of the second leg to the manifold, and a third bleed of air opening connecting the manifold to the beginning of the fifth leg.

5. The industrial gas turbine stator vane of claim 4, and further comprising:

the cooling air bypass of the outer diameter endwall metering connection completely bypasses the third and fourth legs of the serpentine flow cooling circuit.

6. The industrial gas turbine stator vane of claim 1, and further comprising:

a row of cooling air exit slots arranged along the trailing edge of the vane and connected to the fifth leg of the serpentine flow circuit to provide cooling air to the trailing edge region of the vane.

7. A process for cooling the interior of a turbine stator vane having an inner endwall and an outer endwall and an airfoil portion extending between the two endwalls with a serpentine flow cooling circuit formed within the airfoil portion, the process comprising the steps of:

passing compressed cooling air through a first leg of the serpentine flow cooling circuit to provide cooling to the leading edge of the vane;

bleeding off a portion of the cooling air at the end of the first leg into a cavity formed on the inner endwall of the vane;

passing the remaining cooling air from the first leg into a second leg of the serpentine flow cooling circuit;

bleeding off a portion of the cooling air at the end of the second leg into a manifold formed on the outer endwall of the vane;

passing the remaining cooling air from the second leg into a fourth leg of the serpentine flow cooling circuit;

passing the cooling air from the cavity into the beginning of the fourth leg to rejoin the cooling air passing through the third leg; and, passing the cooling air from the manifold into the beginning of the fifth leg to rejoin the cooling air passing through the fourth leg.

8. The process for cooling the interior of a turbine stator vane of claim 7, and further comprising the step of:

discharging the cooling air from the fifth leg through a row of cooling exit slots arranged along the trailing edge portion of the vane.

* * * * *